US011479396B2

(12) United States Patent
Villis

(10) Patent No.: US 11,479,396 B2
(45) Date of Patent: Oct. 25, 2022

(54) FOOD PACKAGE

(71) Applicants: Jonathan Ling, Bridgend (GB); Simon Villis, Bridgend (GB)

(72) Inventor: Simon Villis, Llangynwyd (GB)

(73) Assignee: Jonathan Ling, Coity (GB)

( * ) Notice: Subject to any disclaimer, the term of this patent is extended or adjusted under 35 U.S.C. 154(b) by 0 days.

(21) Appl. No.: 17/330,713

(22) Filed: May 26, 2021

(65) Prior Publication Data

US 2021/0276778 A1 Sep. 9, 2021

Related U.S. Application Data

(63) Continuation-in-part of application No. 16/486,456, filed as application No. PCT/EP2018/054387 on Feb. 22, 2018, now abandoned.

(30) Foreign Application Priority Data

Mar. 2, 2017 (GB) ..... 1703354

(51) Int. Cl.

| | |
|---|---|
| ***B65D 75/58*** | (2006.01) |
| ***B65D 75/20*** | (2006.01) |
| ***B65B 43/26*** | (2006.01) |
| ***B65B 5/06*** | (2006.01) |
| ***B65B 25/00*** | (2006.01) |
| ***B65B 69/00*** | (2006.01) |

(52) U.S. Cl.

CPC ..... *B65D 75/58* (2013.01); *B65B 5/062* (2013.01); *B65B 5/064* (2013.01); *B65B 25/005* (2013.01); *B65B 43/26* (2013.01); *B65B 69/0008* (2013.01); *B65D 75/20* (2013.01)

(58) Field of Classification Search

CPC ..... B65D 75/58; B65D 75/20; B65B 5/062; B65B 5/064; B65B 25/005; B65B 43/26; B65B 69/0008

USPC ..... 426/115

See application file for complete search history.

(56) References Cited

U.S. PATENT DOCUMENTS

| | | | | |
|---|---|---|---|---|
| 1,453,015 A | | 4/1923 | Lavigne | |
| 1,732,680 A | | 10/1929 | Hanlon | |
| 2,071,439 A | | 2/1937 | Snow | |
| 2,127,631 A | * | 8/1938 | Nagle | B65D 5/008 383/123 |
| 2,584,632 A | | 2/1952 | Southwick | |

(Continued)

FOREIGN PATENT DOCUMENTS

| | | |
|---|---|---|
| EP | 2607261 A1 | 6/2013 |
| EP | 2592017 B1 | 9/2015 |

(Continued)

*Primary Examiner* — Jes F Pascua

(74) *Attorney, Agent, or Firm* — Smartpat PLC

(57) ABSTRACT

A package for products comprises: at least two flexible adjoined layers configured to provide a cavity extending therebetween for containing a product. The at least two flexible adjoined layers are moveable between: a first closed configuration in which the flexible adjoined layers are sealed around the entire periphery thereof to isolate the cavity from an external environment; and a second open configuration in which the flexible adjoined layers extend in a substantially cone shaped configuration, and in which the base of the substantially cone shaped configuration provides an opening extending into the cavity.

16 Claims, 4 Drawing Sheets

(56) References Cited

U.S. PATENT DOCUMENTS

| | | | | |
|---|---|---|---|---|
| 2,827,939 | A * | 3/1958 | Ames | B65D 75/20 426/123 |
| 2,893,876 | A | 7/1959 | James | |
| 3,009,627 | A | 11/1961 | Ottinger | |
| 3,129,815 | A * | 4/1964 | Baxter | B65D 75/20 426/115 |
| 3,199,275 | A | 8/1965 | Fesco | |
| 3,617,311 | A | 11/1971 | Beltle et al. | |
| 4,006,764 | A | 2/1977 | Yamamoto et al. | |
| 4,608,259 | A | 8/1986 | Cortopassi | |
| 4,644,732 | A | 2/1987 | Morton | |
| 6,007,246 | A | 12/1999 | Kinigakis et al. | |
| 6,060,095 | A | 5/2000 | Scrimager | |
| 9,938,047 | B2 * | 4/2018 | Batarseh | B65D 33/2541 |
| 2009/0074333 | A1 | 3/2009 | Griebel et al. | |
| 2011/0033136 | A1 * | 2/2011 | Marchand | B65D 31/16 383/105 |
| 2015/0217919 | A1 | 8/2015 | Varbanov et al. | |
| 2018/0118440 | A1 | 5/2018 | Asai et al. | |
| 2019/0002182 | A1 * | 1/2019 | Chen | B65D 77/064 |
| 2021/0269213 | A1 * | 9/2021 | Burley | B65D 75/5805 |

FOREIGN PATENT DOCUMENTS

| | | | |
|---|---|---|---|
| FR | 2819487 | A1 | 7/2002 |
| JP | H11321885 | A | 11/1999 |
| JP | 2003252364 | A | 9/2003 |
| WO | 9919233 | A1 | 4/1999 |
| WO | 2010121731 | A1 | 10/2010 |
| WO | 2016184818 | A1 | 11/2016 |

* cited by examiner

FOOD PACKAGE

CROSS-REFERENCE TO RELATED APPLICATION

This application is Continuation in Part of U.S. application Ser. No. 16/486,456, filed Aug. 15, 2019, which is a national stage application, filed under 35 U.S.C. § 371, of International Patent Application No. PCT/EP2018/054387, filed on Feb. 22, 2018, which claims the benefit of UK Patent Application No. 1703354.9, filed Mar. 2, 2017.

TECHNICAL FIELD

This disclosure pertains generally to a package for a product. More particularly, the disclosure relates to a package for a food product, such as for example chips, popcorn, nuts, confectionary or chocolate.

BACKGROUND

Conventional packages of food products, such as for example crisps, popcorn, nuts, confectionary or chocolate, are openable along the top edge. The present inventor has identified that the opening into the package is rather restrictive in size and can cause grease or particles on the inside of the package to come into contact with the user's skin. The present inventor has also identified that due to the restricted access to the food product within the package it is difficult for a user to be able to identify and pick out a specific item of food product or to share the contents easily between a number of people.

There is a need for improvements in packages, in particular in packages for food products such as for example crisps, popcorn, nuts, confectionary or chocolate.

It is an object of this invention to provide a package for food products which provides improved access to the contents compared to conventional packages.

SUMMARY

A novel package for products comprises at least two flexible adjoined layers configured to provide a cavity extending therebetween for containing a product. The at least two flexible adjoined layers are moveable between a first closed configuration in which the flexible adjoined layers are sealed around the entire periphery thereof to isolate the cavity from an external environment and a second open configuration in which the flexible adjoined layers extend in a substantially cone shaped configuration defining the cavity therebetween. The base of the substantially cone shaped configuration provides an opening extending into the cavity.

The package is preferably a package for food products, such as for example crisps, popcorn, nuts, confectionary or chocolate.

The package, in the first closed configuration, may have a substantially truncated rectangular or square shape. The term "truncated" is used herein to refer to the shape having a missing corner. In the first closed configuration, the package may be a substantially truncated rectangular or square shape having three corners.

The package may comprise any suitable number of flexible adjoined layers. Preferably, the package contains two flexible adjoined layers. The two flexible adjoined layers may be provided by a single flexible member configured to provide a first flexible layer providing a front face of the packet, and a second flexible layer providing a rear face of the packet. The flexible layers provided by the single flexible member are preferably adjoined along at least the bottom end of the package.

The flexible layers preferably provide a front face and an opposed rear face of the packet. Each of the flexible layers comprise a top end and an opposed bottom end. Each of the flexible adjoined layers preferably comprises a first corner provided at the top end, a diagonally opposed second corner provided at an opposed bottom end, and an openable seam extending therebetween.

The term "cone" or "cone shaped" is used here in to refer to a three-dimensional geometric shape that tapers smoothly from a base to a point called the apex. The base may in some embodiments be substantially circular in shape. It is however to be understood that the base may have any suitable shape and is not to be limited to a substantially circular shape. The base may for example be an ovaloid or semi-circular in shape. The term "cone" or "cone shaped" is used herein to also include cones having a polygonal base, which are also known to be referred to as pyramids. Pyramids comprise a polygonal base and triangular shaped sides which meet at the apex.

In one embodiment, each of the flexible adjoined layers comprises a third corner provided at the opposed bottom end and spaced apart from the second corner. The third corner is preferably aligned with the first corner of the flexible layers. In the second open configuration, the third corner preferably forms the apex of the substantially cone shaped configuration.

The length of the package is defined as being measured from the top end to the bottom end of the package in a direction extending substantially perpendicular to the top and/or bottom ends of the package. Preferably, the length of the package is measured between the first corner and the third corner of the flexible layers. For example, the length of the package may be measured between the first corner and the apex formed by the flexible layers in the second configuration.

In the second configuration, the opening is offset from the length of the package as measured between the first corner and the apex (or third corner) of the flexible layers. Access through the opening to the cavity provided between the flexible layers is preferably in a direction extending at an angle to the length of the package as measured between the first corner and the apex (or third corner) of the flexible layers.

In one embodiment, the openable seam is resealable.

In the first configuration, the openable seam preferably extends along at least a portion of the periphery of the package.

In the first configuration, the openable seam preferably comprises an arcuate portion extending between the first and second corners.

In the first configuration, the openable seam preferably comprises a first seam portion extending from the first corner and extending substantially parallel to the bottom end of the packet. A second seam portion extends from the second corner and extending substantially perpendicular to the bottom end of the packet. A third seam portion extends at an angle to the first seam portion and the second seam portion and extending therebetween.

In the first configuration, the third seam portion preferably comprises an arcuate portion extending between the first and second seam portions.

In the first configuration, the third seam portion preferably comprises a linear portion extending between the first and second seam portions.

In the first configuration, the third seam portion may extend at an angle of between 0 degrees and 90 degrees; preferably at an angle of between 10 degrees and 80 degrees; more preferably at an angle of between 20 degrees and 70 degrees; more preferably at an angle of between 30 degrees and 60 degrees, more preferably at an angle of between 40 degrees and 50 degrees, for example at about 45 degrees relative to the first seam portion.

The openable seam may be openable along a portion of the seam or along the entire length of the seam.

Preferably, at least the third seam portion is openable. Preferably, the third seam portion and at least one of the first and second seam portions are openable.

Preferably, each of the first, second and third seam portions are openable.

In the first configuration, at least a portion of the openable seams preferably extends along the periphery of the package. Preferably, at least the third seam portion extends along the periphery of the package. Preferably, at least the third seam portion and one or both of the first and second seam portions extend along the periphery of the package. Preferably, each of the first, second and third seam portions extend along the periphery of the package.

Preferably the openable seam is openable by parting the flexible layers along the seam. The seam may for example be a heat sealed seam or the flexible layers may be adjoined together by adhesive along the seam. The openable seam may be provided by a line of perforations. The openable seam may be provided by a tear off strip.

The at least two flexible layers may be composed of any suitable materials. In one embodiment, the flexible layers are composed from one or more materials selected from: oriented polypropylene, polypropylene, polyethylene, polyethylene terephthalate, waxed paper, paperboard, cardboard, and/or metal foil.

In one embodiment, the flexible layers of the package are resiliently biased towards the second configuration. For example, the flexible layers are configured such that on opening the openable seam, the package springs towards the second configuration. In particular the package may be configured such that at least the portions of the first and second flexible layers located at or adjacent to the openable seam are resiliently biased to extend away from each other.

According to a second aspect of the present invention there is provided a method of manufacturing a package as herein described, the method comprising:

a. providing at least two flexible layers;
b. adjoining the at least two flexible layers along at least a bottom end; and
c. providing an openable seam configured in the first configuration to extend between a first corner at a top end of the flexible layers and a diagonally opposed second corner at the bottom end of the flexible layers.

The package may be openable along the openable seam to provide improved access to the contents of the package. In the second open configuration, the package provides improved access to the package contents. In particular the size and/or shape of the opening provided by the package in the second configuration enables the user to be able to share the contents of the package more easily when compared to conventional packages. Furthermore, in the second open configuration, the size and shape of the opening enables the user an improved view of the contents of the package. As such, the user may be able to be more selective as to which specific item of food product the user wishes to remove from the package. In some embodiments, the second open configuration the package forms a more sturdy and robust configuration when compared to conventional packages. In the second configuration the package is able to be held more easily and securely by a user. As a result, the user may share the contents of the package more easily.

A third aspect relates to a method based on providing a pentagonal product package having a substantially truncated rectangular shape with five edges, in which the product package comprises two flexible adjoined layers configured to provide a cavity extending therebetween for containing a product. The method includes moving the flexible adjoined layers from a first closed configuration in which the flexible adjoined layers are sealed around an entire periphery of the product package to isolate the cavity from an external environment into a second open configuration in which the flexible adjoined layers extend in a substantially cone shaped configuration defining the cavity therebetween, and in which a base of the substantially cone shaped configuration provides an opening extending into the cavity.

Moving the flexible adjoined layers may include separating a seam along three of the five edges of the pentagonal product. Separating the seam along three of the five edges of the pentagonal product may include tearing off a perforated portion of the pentagonal product or separating a portion of the pentagonal product connected by an adhesive.

The two flexible adjoined layers may be a front layer and a rear layer. The five edges may include a first lateral edge, a second lateral edge, a top end, a bottom end, and a cutout edge. The pentagonal product package may be made of a single sheet of material having been folded along the first lateral edge to form the front layer and the rear layer. The cutout edge may extend from the second lateral edge to the top end. There need not be any further fold in the product package besides the first lateral edge.

The front layer and the rear layer may be connected to each other by seam along the second lateral edge, the cutout edge, and the top end whereas the first lateral edge and the bottom end do not include the seam. The seam may be an adhesive connection or a separable weld.

The front layer and the rear layer are connected to one another at the top end by a separable connection and connected to one another at the bottom end by an inseparable connection. The separable connection may require a pulling force of less than 50 N, possibly even less than 25 N, to separate.

The single sheet of material may include a left edge and a right edge which are overlappingly adjoined along a vertical seam in the rear layer.

The flexible adjoined layers may be connected to one another by a seam extending along exactly three adjacent ones of the five edges. The second lateral edge of the package may be shorted than its first lateral edge, and its top end may be shorter than its bottom end.

A force required to separate the front layer from the rear layer along the bottom end may be greater than a force required to separate the front layer from the rear layer along the cutout edge. A pulling force required to separate the flexible adjoining layers along the seam may be less than 100 N.

A connection between the front layer and the rear layer along the cutout edge may be resealable.

The package may be used for foodstuff, in particular chips, popcorn, nuts, seeds, raisins, pretzels, crackers, cereal, cookies, confectionary, and chocolate.

Whilst the embodiments described herein are related to food package, it is also possible to utilize any of the described technologies or methods in association with any other type of package.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may refer to different embodiments. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

The invention will now be described by a detailed description of an embodiment of the invention. It is clear that other embodiments of the invention can be configured according to the knowledge of persons skilled in the art without departing from the true spirit or technical teaching of the invention, the invention being limited only by the terms of the appended claims.

An embodiment of the present invention will now be described in further detail with reference to the following Figures:

DETAILED DESCRIPTION

Figure 1A:
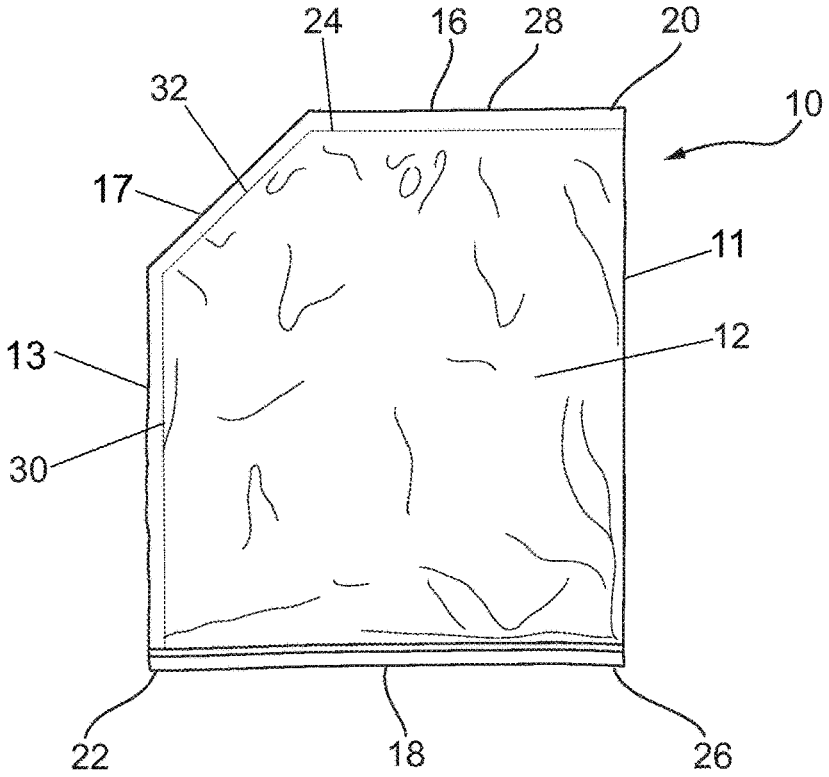
FIG. 1A is an illustration of a front view of a package according to one embodiment of the present invention when the package is in the first closed position.

The disclosure concerns packaging. In particular this disclosure concerns a package for a product, such as for example a food product. The food product may be for example crisps, popcorn, nuts, confectionary or chocolate. It is however to be understood that the package may be used for containing or storing any suitable product and is not to be limited to food products.

With reference to the figures, the package 10 comprises two flexible adjoined layers 12, 14. A first flexible layer 12 (front layer) provides the front face of the package 10. A second flexible layer 14 (rear layer) provides the rear face of the package 10.

It is to be understood that the package may comprise any suitable number of flexible adjoined layers in order to form the package 10. In the illustrated embodiment the package contains two flexible adjoined layers 12, 14. The two flexible adjoined layers may be provided by a single flexible member that is folded to provide a first flexible layer providing a front face of the package, and a second flexible layer providing a rear face of the package. The package may in some embodiments further comprise one or more internal panels, such as for example divider panels, to provide multiple cavities within the package. Each internal panel may be provided by a flexible layer adjoined to the first and second layers. In one embodiment, each internal panel may be provided by a flexible layer adjoined to the internal surface of one of the first or second layers.

In the first closed configuration, each of the flexible layers 12, 14 comprises a top end 16, 16' and an opposed bottom end 18. Each of the flexible adjoined layers 12, 14 comprises a first corner 20 provided at the top end 16, a diagonally opposed second corner 22 provided at an opposed bottom end 18, and an openable seam 24 extending therebetween. The top end 16 and the bottom end 18 are edges of the package.

In the first closed configuration, the two flexible layers 12, 14 are joined together along the bottom end 18 of the package 10. In particular, the front layer 12 and the rear layer 14 may be inseparably connected to each other by a strong weld. Within the context of this disclosure a connection between two layers will be considered "inseparable" or "strong" if a force required to separate the layers exceeds 100 N. A connection is considered "separable" or "openable" if a force required to separate the layers does not exceed 100 N. For improved usability it may be preferred to design the separable connection such that a force required to open the package does not exceed 50 N. For some use-cases it is desirable that the opening force does not exceed 25 N.

The package 10 may be made of a single sheet of material that has been folded along a first lateral edge 11. The sheet may include a left edge and a right edge which are overlappingly adjoined along a vertical seam 15 extending substantially perpendicular to the bottom end 18 of the package 10. The seam 15 may be located at any suitable location on the package 10. In the illustrated embodiment the seam 15 is provided in the second flexible layer 14 at the rear of the package 10.

It is however also to be understood that the package may not need a separate seam 15. Rather, the single sheet may be symmetrically folded along the first lateral edge 11 to form the front layer 12 and the rear layer 14. The front layer 12 and the rear layer 14 may then be connected to each other along a second lateral edge 30 by a seam. The folded edge 11 may extend substantially perpendicular to the bottom end 18 of the package 10.

In the first closed configuration, each of the flexible adjoined layers 12, 14 comprises a third corner 26 provided at the opposed bottom end 18 and spaced apart from the second corner 22. The third corner 26 is aligned with the first corner 20 of the flexible layers 12, 14. In the first closed configuration, the package 10 forms a truncated substantially rectangular shape. It is however to be understood that the package 10 may have any suitable shape. For example, in one embodiment, the package may form a truncated substantially square shape in the first configuration. The terms "truncated rectangular" and "truncated square" are used herein to refer to rectangular or square shapes which are missing a corner.

The length of the package 10 is measured between the first corner 20 and third corner 26. The length of the package 10 is measured in a direction extending substantially perpendicular to the top 16 and bottom 18 ends of the package 10.

The front layer 12 and the rear layer 14 are congruent and connected to one another by a lateral fold along a first lateral edge 11. The first lateral edge 11 is longer than a parallel second lateral edge 13 on an opposite side of the package. Similarly, the bottom end 18 is longer than the top end 16 of the package. The cutout edge 17 extends from the second lateral edge 13 to the top edge 16.

With reference to FIGS. 1A, 1B, 2A and 2B, in the first closed configuration, the openable seam 24 extends along a peripheral portion of the package 10. In particular, the openable seam 24 extends along the top end 16, a cutout edge 32, and a second lateral edge 30.

Figure 1B:
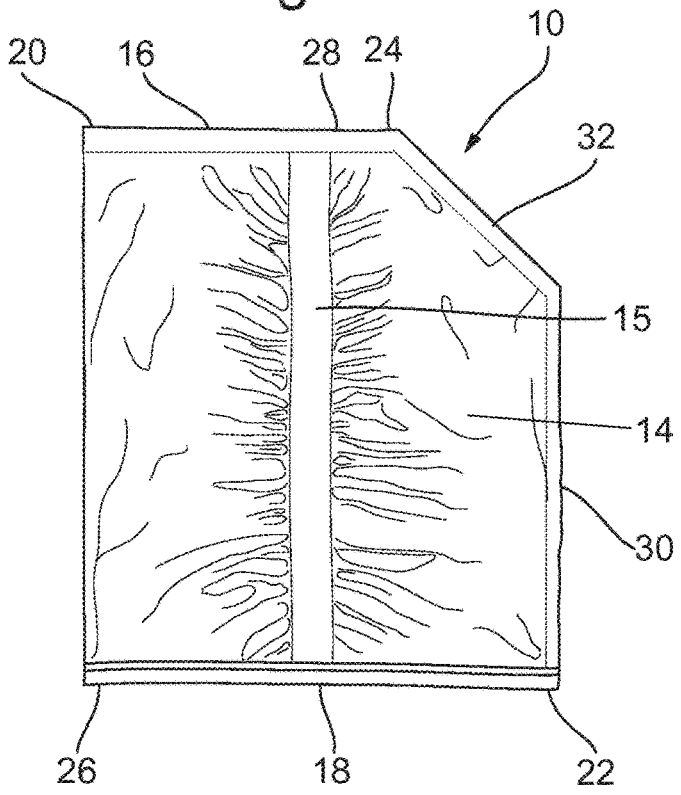
FIG. 1B is an illustration of a rear view of the package of FIG. 1A in the first closed configuration.

With reference to FIGS. 1A and 1B, when viewed from the front of the package, as provided by the first flexible layer 12, the openable seam 24 extends along the periphery of the package and extends in an anticlockwise direction from or adjacent the first corner 20 towards the second corner 22 of the package 10.

Figure 2A:
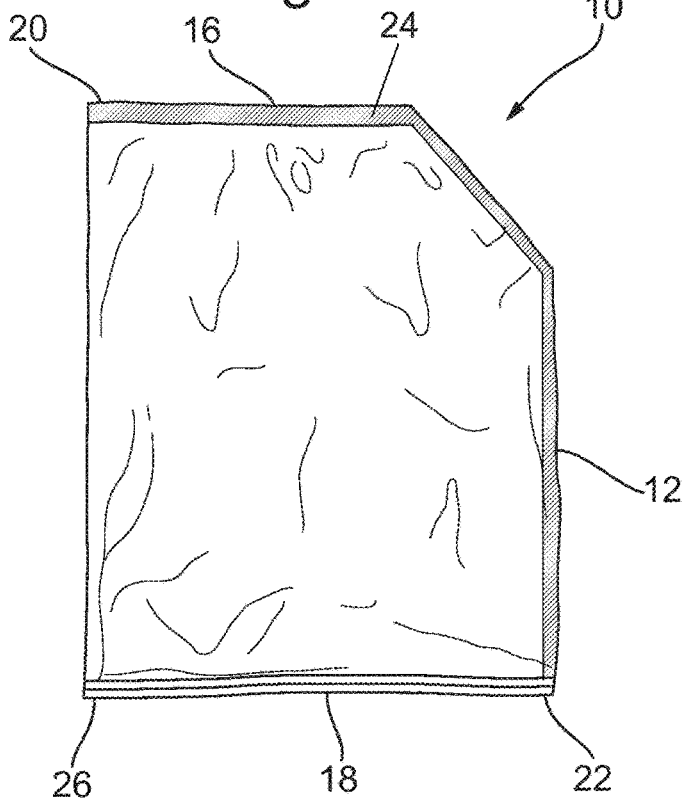
FIG. 2A is an illustration of a front view of a package according to a further embodiment of the present invention when the package is in the first closed position.
Figure 2B:
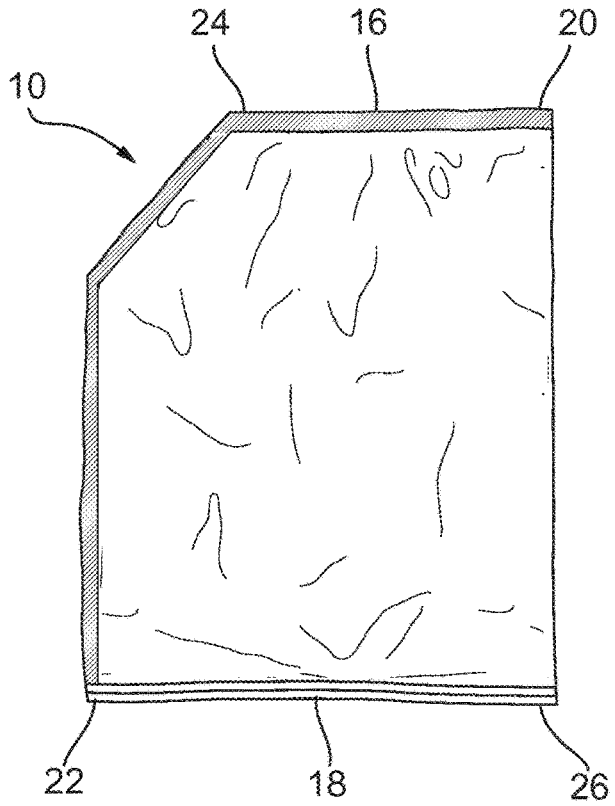
FIG. 2B is an illustration of a rear view of the package of FIG. 2A in the first closed configuration.
Figure 3:
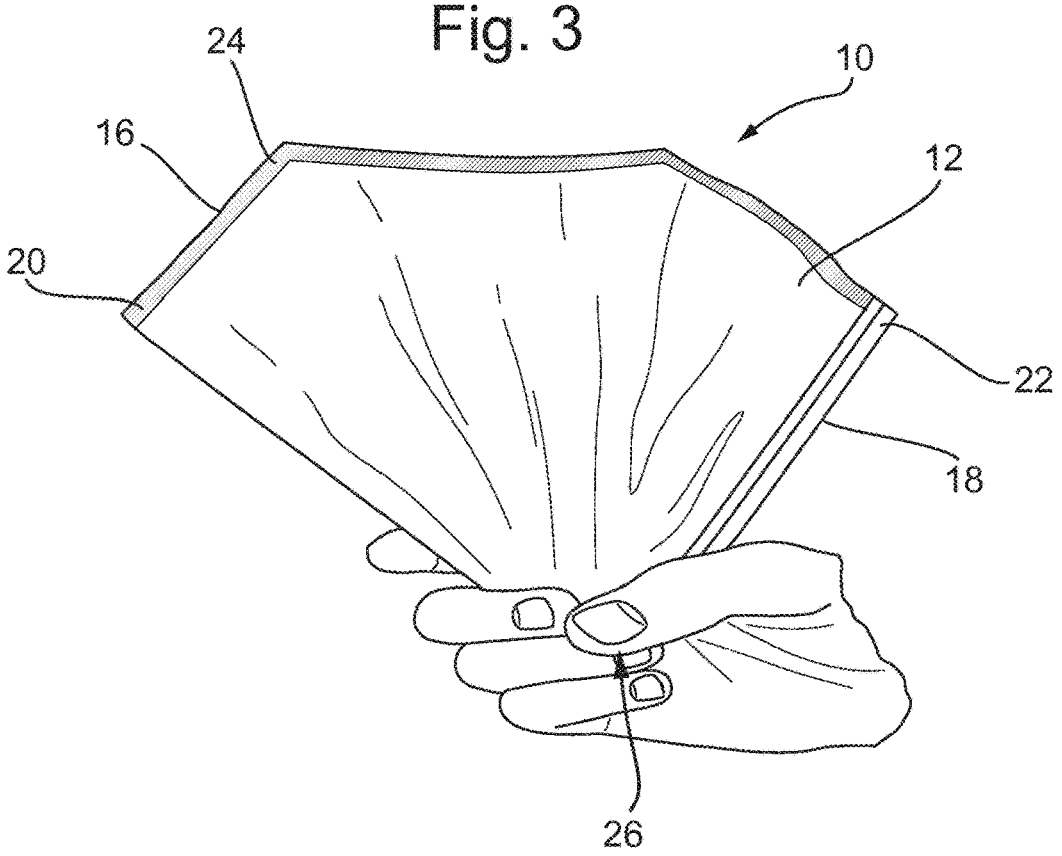
FIG. 3 is an illustration of a side view of the package of FIGS. 2A and 2B when in the second open position.

With reference to FIGS. 2A and 2B, when viewed from the front of the package, as provided by the first flexible layer 12, the openable seam 24 extends along the periphery of the package and extends in a clockwise direction from or adjacent the first corner 20 towards the second corner 22 of the package 10.

In the first closed position, the openable seam 24 comprises a first seam portion 28 extending along the top end 16 from or adjacent to the first corner 20 in a direction extending substantially parallel to the bottom end 18 of the package 10.

In the first closed position, the openable seam 24 further comprises a second seam portion 30 extending from or adjacent to the second corner 22 in a direction extending substantially perpendicular to the bottom end 18 of the package 10 along a second lateral edge 13 of the package.

In the first closed position, the openable seam 24 further comprises a third seam portion 32 extending at an angle to each of the first seam portion 28 and the second seam portion 30 and extending therebetween along a cutout edge 17.

It can be seen from FIGS. 1A, 1B, 2A and 2B that in the first closed position the third seam portion 32 comprises a straight portion extending between the first 28 and second 30 seam portions. It is however to be understood that the third seam portion 32, and correspondingly the cutout edge 17, may have any suitable shape. For example, the third seam portion 30 may comprise one or more arcuate portions extending between the first 28 and second 30 seam portions.

In FIGS. 1A, 1B, 2A and 2B it can be seen that the third seam portion 32 extends at an angle of approximately 45 degrees relative to the first seam portion 28. It is however to be understood that the third seam portion 32 may extend at any suitable angle relative to the first seam portion 28.

In the first closed configuration, as shown in FIGS. 1A, 1B, 2A and 2B, the flexible adjoined layers 12, 14 of the package are sealed around the entire periphery of the package to isolate the cavity from the external environment.

The package 10 is moveable between the first closed configuration as shown in FIGS. 1A, 1B, 2A and 2B and a second open configuration as shown in FIGS. 3 to 6.

In use, the user opens the openable seam 24. The openable seam 24 may be opened by applying a pulling force to separate the first and second flexible layers 12, 14 from each other along the length of the openable seam 24. Alternatively, the openable seam 24 may comprise a slideable opening mechanism which may be slidably opened by the user to separate the adjacent portions of the first and second flexible layers 12, 14 from each other. In one embodiment, the openable seam 24 may be provided by a tear off portion or by a line of perforations. The openable seam may be a heat sealed seam or the flexible layers may be adjoined together by adhesive along the openable seam. The adhesive or heat-sealing is indicated by a hatched area along the seam 24 in FIGS. 2A, 2B, 3, and 4.

The openable seam 24 opens along the entire length of the seam. In particular, the first 28, second 30, and third 32 seam portions open providing access to the contents of the package 10. It is however to be understood that in some embodiments only a portion of the openable seam 24 may be openable.

In one embodiment, the package 10 is configured such that the first and second flexible layers 12, 14 are resiliently biased towards the second open configuration. In particular, the package 10 is configured such that the portions of the first and second flexible layers 12, 14 adjacent to the openable seam 24 are resiliently biased to extend away from each other.

Figure 4:
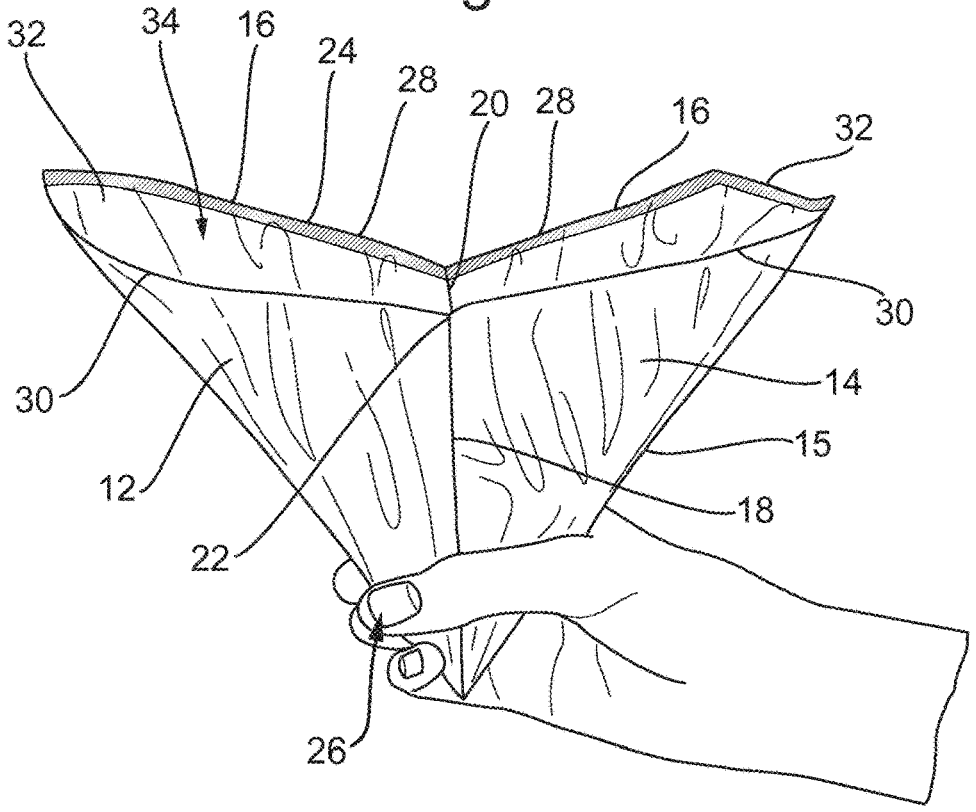
FIG. 4 is an illustration of a further side view of the package of FIGS. 2A and 2B when in the second open position.
Figure 5:
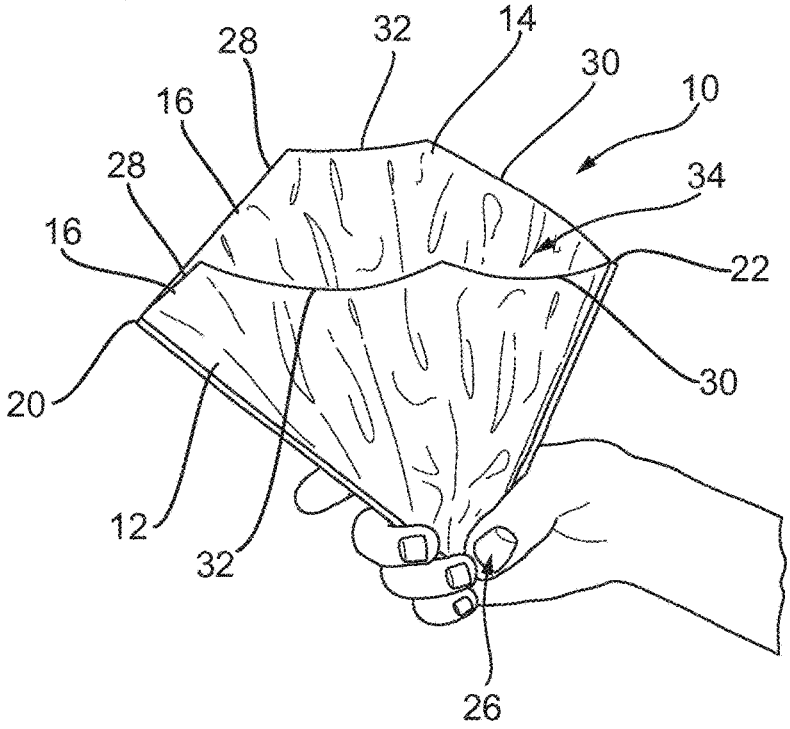
FIG. 5 is a further illustration of a further side view of the package of FIGS. 2A and 2B when in the second open position.
Figure 6:
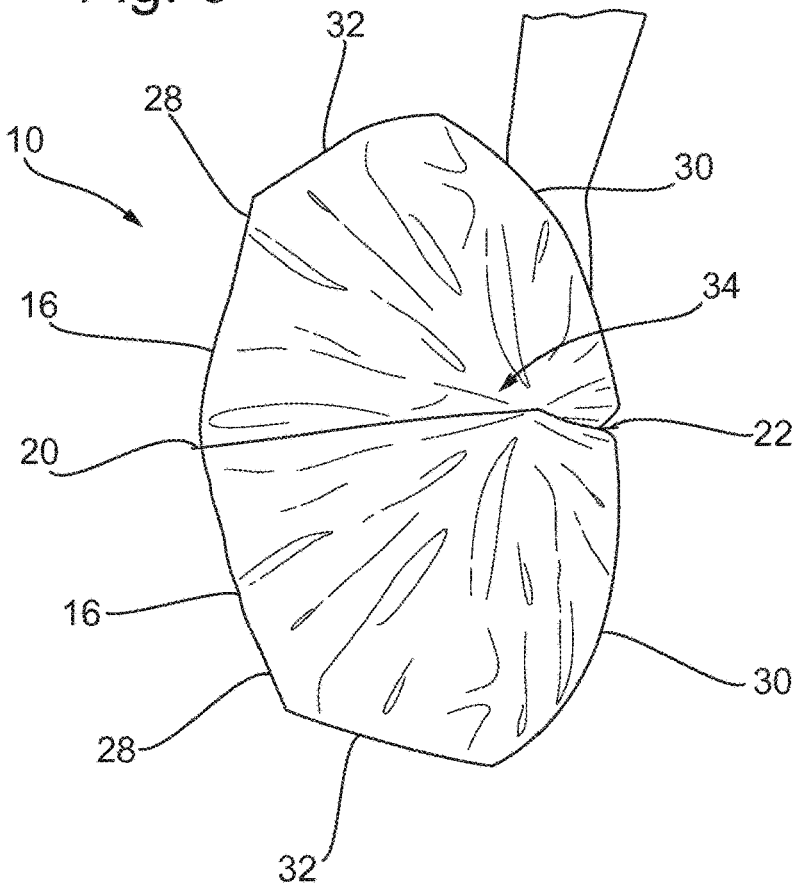
FIG. 6 is an illustration of a view from above of the package of FIGS. 2A and 2B when in the second open position.

In the second open configuration, the package 10 is in a substantially cone-shaped configuration as shown in FIGS. 4 to 6. The third corner 26 of the package 10 forms the apex of the cone shaped configuration. The base of the cone shaped configuration of the package 10 provides the opening 34 into the cavity provided by the package 10. It can be seen in FIG. 4 that the opening 34 is substantially ovaloid in shape. It is however to be understood that the opening may have any suitable shape including for example, but not to be limited to, circular, semi-circular, polygonal, square, rectangular, pentagonal, hexagonal, and other multi-sided shapes.

It can be seen in FIGS. 4 to 6 that the opening 34 is offset from the length of the package 10 as measured between the first corner 20 and the apex provided by the third corner 26 of the flexible layers 12, 14. In particular, the opening 34 extends at an angle to the length of the package 10 extending between the first corner 20 and the apex provided by the third corner 26. Access through the opening 34 to the cavity provided between the flexible layers 12, 14 is in a direction extending at an angle to the length of the package extending between the first corner 20 and the apex provided by the or third corner 26 of the flexible layers 12, 14.

It can be seen from FIGS. 3 to 6, that in the second open configuration the package 10 provides improved and easier access to the contents within the cavity provided between the first and second flexible layers 12, 14. In some embodiments, the package provides a more sturdy and robust open configuration compared to conventional package enabling easy and secure handling. In particular the package provides an apex (corner 26) providing easy handling of the package by the user. The opening provided by the package of the present invention provides for easier access to the contents of the package as well as providing improved visual access to the contents of the package. The user may therefore be able to share and access the contents more easily with a reduced risk of contacting the internal surfaces of the package, thereby reducing the risk of grease and/or food particle transfer onto the hands of a user. The user may also be able to visually assess the contents more easily with a view to selecting the preferred item of food product within the package when compared to conventional package.

The invention has been described with reference to a preferred embodiment. However, it will be appreciated that variations and modifications can be effected by a person of ordinary skill in the art without departing from the scope of the invention.

What is claimed is:

1. A method, comprising:

providing a pentagonal product package having a substantially truncated rectangular shape with five edges, in which the product package comprises two flexible adjoined layers configured to provide a cavity extending therebetween for containing a product; and moving the flexible adjoined layers from a first closed configuration in which the flexible adjoined layers are sealed around an entire periphery of the product package to isolate the cavity from an external environment into a second open configuration in which the flexible adjoined layers extend in a substantially cone shaped configuration defining the cavity therebetween, and in which a base of the substantially cone shaped configuration provides an opening extending into the cavity, wherein the two flexible adjoined layers are a front layer and a rear layer, wherein the five edges include a first lateral edge, a second lateral edge, a top end, a bottom end, and a cutout edge, and wherein the pentagonal product package is made of a single sheet of material having been folded along the first lateral edge to form the front layer and the rear layer, and wherein the cutout edge extends from the second lateral edge to the top end, wherein the front layer and the rear layer are connected to one another at the top end by a separable connection, and wherein the front layer and the rear layer are connected to one another at the bottom end by an inseparable connection.

2. The method as in claim 1, wherein moving the flexible adjoined layers includes separating a seam along three of the five edges of the pentagonal product.

3. The method as in claim 2, wherein separating the seam along three of the five edges of the pentagonal product includes tearing off a perforated portion of the pentagonal product.

4. The method as in claim 1, wherein there is no further fold in the product package besides the first lateral edge.

5. The method as in claim 1, wherein the front layer and the rear layer are connected to each other by a seam along the second lateral edge, the cutout edge, and the top end, and wherein the seam does not extend along the first lateral edge and the bottom end.

6. The method as in claim 5, wherein the seam is an adhesive connection.

7. The method as in claim 5, wherein the seam is a separable weld.

8. The method as in claim 1, wherein the single sheet of material includes a left edge and a right edge which are overlappingly adjoined along a vertical seam in the rear layer.

9. The method as in claim 1, wherein the second lateral edge is shorter than the first lateral edge, and wherein the top end is shorter than the bottom end, and wherein the front layer and the rear layer are congruent.

10. The method as in claim 1, wherein a connection between the front layer and the rear layer along the cutout edge is resealable.

11. The method as in claim 1, wherein the flexible adjoined layers are connected to one another by a seam extending along exactly three adjacent ones of the five edges.

12. The method as in claim 11, wherein a pulling force required to separate the flexible adjoining layers along the seam is less than 100 N.

13. The method as in claim 1, wherein the product is a foodstuff.

14. The method as in claim 13, wherein the foodstuff is selected from the group consisting of chips, popcorn, nuts, seeds, raisins, pretzels, crackers, cereal, cookies, confectionary, and chocolate.

15. A method, comprising:

providing a pentagonal product package having a substantially truncated rectangular shape with five edges, in which the product package comprises two flexible adjoined layers configured to provide a cavity extending therebetween for containing a product; and moving the flexible adjoined layers from a first closed configuration in which the flexible adjoined layers are sealed around an entire periphery of the product package to isolate the cavity from an external environment into a second open configuration in which the flexible adjoined layers extend in a substantially cone shaped configuration defining the cavity therebetween, and in which a base of the substantially cone shaped configuration provides an opening extending into the cavity, wherein moving the flexible adjoined layers includes separating a seam along three of the five edges of the pentagonal product wherein separating the seam along three of the five edges of the pentagonal product includes separating a portion of the pentagonal product connected by an adhesive.

16. The method as in claim 5, A method, comprising:

providing a pentagonal product package having a substantially truncated rectangular shape with five edges, in which the product package comprises two flexible adjoined layers configured to provide a cavity extending therebetween for containing a product; and moving the flexible adjoined layers from a first closed configuration in which the flexible adjoined layers are sealed around an entire periphery of the product package to isolate the cavity from an external environment into a second open configuration in which the flexible adjoined layers extend in a substantially cone shaped configuration defining the cavity therebetween, and in which a base of the substantially cone shaped configuration provides an opening extending into the cavity, wherein the two flexible adjoined layers are a front layer and a rear layer, wherein the five edges include a first lateral edge, a second lateral edge, a top end, a bottom end, and a cutout edge, wherein the pentagonal product package is made of a single sheet of material having been folded along the first lateral edge to form the front layer and the rear layer, wherein the cutout edge extends from the second lateral edge to the top end, wherein the front layer and the rear layer are connected to one another at the cutout edge by a first connection, wherein the front layer and the rear layer are connected to one another at the bottom end by a second connection wherein a force required to separate the second connection is greater than a force required to separate the first connection.

* * * * *